United States Patent [19]

Shiba et al.

[11] 3,933,505

[45] Jan. 20, 1976

[54] FOGGED, DIRECT POSITIVE SILVER HALIDE EMULSION CONTAINING A NITRO-SUBSTITUTED FLUORENE DESENSITIZER

[75] Inventors: Keisuke Shiba; Masanao Hinato; Reiichi Ohi, all of Minami-ashigara, Japan

[73] Assignee: Fuji Photo Film Co., Ltd., Minami-ashigara, Japan

[22] Filed: Dec. 18, 1973

[21] Appl. No.: 425,747

[30] Foreign Application Priority Data

Dec. 18, 1972 Japan ..... 47-126862

[52] U.S. Cl. ..... 96/101; 96/107; 96/108; 96/120; 96/129; 96/130; 96/139

[51] Int. Cl.[2] ..... G03C 1/36

[58] Field of Search ..... 96/101, 107, 108, 120, 96/95, 1.5, 129, 130, 139

[56] References Cited

UNITED STATES PATENTS

| | | | |
|---|---|---|---|
| 2,693,416 | 11/1954 | Butterfield | 96/15 |
| 3,062,651 | 11/1962 | Hillson | 96/95 |

OTHER PUBLICATIONS

Chemical Abstract Vol. 72, 1970 P. 84936g.

*Primary Examiner*—Won H. Louie, Jr.
*Attorney, Agent, or Firm*—Sughrue, Rothwell, Mion Zinn & Macpeak

[57] ABSTRACT

A silver halide photographic emulsion for direct positives, containing a fluorene compound having at least one nitro group as a substituent.

22 Claims, No Drawings

FOGGED, DIRECT POSITIVE SILVER HALIDE EMULSION CONTAINING A NITRO-SUBSTITUTED FLUORENE DESENSITIZER

BACKGROUND OF THE INVENTION

1. Field of the Invention

This invention relates to a silver halide photographic emulsion and, more particularly, it is concerned with a silver halide photographic emulsion for direct positives containing a nitro-substitued fluorene derivative.

2. Description of the Prior Art

When a silver halide light-sensitive material is exposed to a light within the light-sensitive wavelength range of this light-sensitive material and developed, the blackened density increases and leads to a maximum value with an increase of the quantity of exposure, but decreases again and forms finally a positive image with a further increase in the quantity of exposure. Such a phenomenon is generally called "solarization". A similar reversal development to that by light is found also with a silver halide which has been fogged optically or chemically in the process of producing the silver halide emulsion. In this specification, the term "direct positive emulsion" means an emulsion which is processed to form a positive image by ordinary exposure and development.

The instant invention relates to a direct positive emulsion sensitive to the blue color region due to the incorporation into the emulsion of an organic desensitizer. For example, in U.S. Pat. No. 3,501,307 an emulsion of the type that is reversed by the use of an organic desensitizer, such as pinakryptol yellow or 5-m-nitrobenzilidene rhodanine, is disclosed. It is known that an emulsion fogged using a relatively small amount of a gold compound or salt and a reducing agent can be advantageously used to obtain a particularly high reversal sensitivity and an organic desensitizer is effective for the sensitization of such an emulsion. However, known organic desensitizers which have hitherto been used for the sensitization in the blue color region have various disadvantages.

In general, an organic desensitizer having a relatively high reversal sensitivity reduces the maximum density of an original emulsion, while, on the other hand, a desensitizer which does not reduce the maximum density gives only a low reversal sensitivity. In this specification, an organic desensitizer-free emulsion will hereinafter be referred to by the term "original emulsion". For example, pinakryptol yellow reduces the maximum density of an original emulsion and colors a photographic material used yellow. 3-ethyl-5-m-nitrobenzilidene rhodanine does not reduce the maximum density as much, but the clarity is bad, that is, the value of minimum density is large. 5-m-Nitrobenzilidene rhodanine does not reduce the maximum density as much and the value of the minimum density is small, that is, the clarity is good, but a low reversal sensitivity is obtained. Therefore, it is very important to find an organic desensitizer for sensitizing in the blue color region, which is capable of giving a high reversal sensitivity without reducing the maximum density and yet retaining a small minimum density.

It is a principal object of the invention to provide a silver halide photographic emulsion for direct positives, which contains an organic desensitizer for sensitization in the blue color region, capable of giving a high sensitivity, being substantially free from any residual coloring and without reducing the maximum density of an original emulsion.

SUMMARY OF THE INVENTION

Objects of this invention can be accomplished by the addition of at least one nitro group-substituted fluorene derivative to an original emulsion.

DETAILED DESCRIPTION OF THE INVENTION

Of the above described nitro-substituted fluorene derivatives, a compound represented by the following general formula (I) is particularly useful,

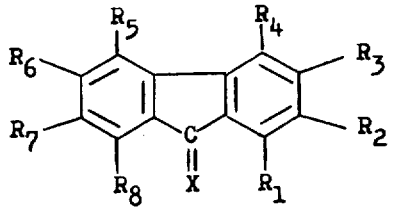

(I)

in which $R_1$, $R_2$, $R_3$, $R_4$, $R_5$, $R_6$, $R_7$ and $R_8$ each represent a hydrogen atom, an alkyl group, a hydroxyl group, a halogen atom or a nitro group with at least one of $R_1$ to $R_8$ representing a nitro group, and X represents an oxygen atom or

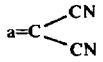

group.

Suitable alkyl groups which can be employed for $R_1$ to $R_8$ include those having up to 8 carbon atoms and suitable halogen atoms are fluoride, chlorine, bromine and iodine.

Examples of nitro-substituted fluorene derivatives which can be used in the present invention are given in the following without intending to limit the present invention. These compounds are well-known compounds described in the literature and can be synthesized using known techniques.

Compound 1

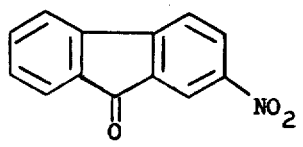

Compound 2

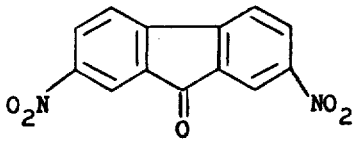

Compound 3
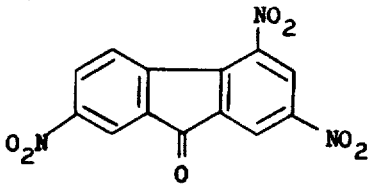
Compound 4
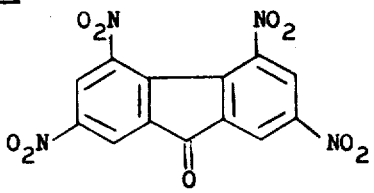
Compound 5
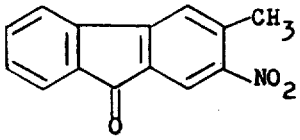
Compound 6
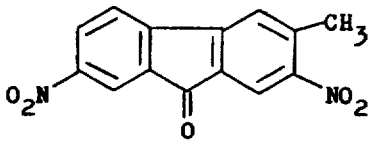
Compound 7
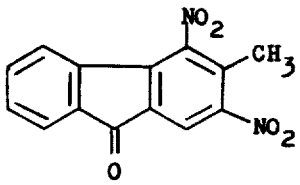
Compound 8
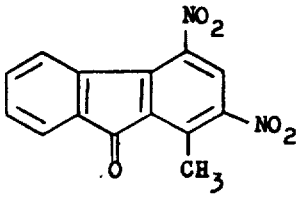
Compound 9
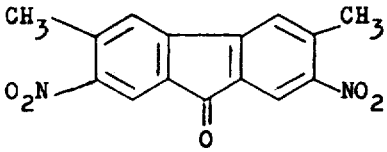
Compound 11
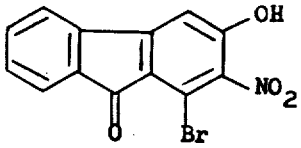
Compound 10
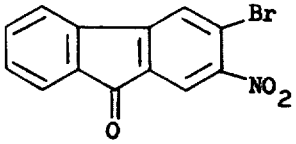
Compound 12
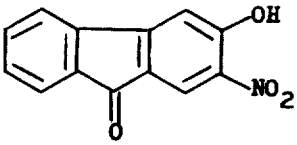
Compound 13
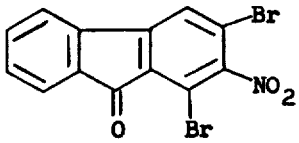
Compound 14
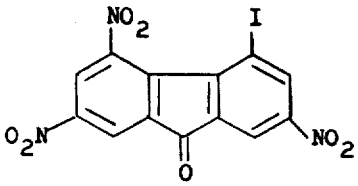

Compound 15

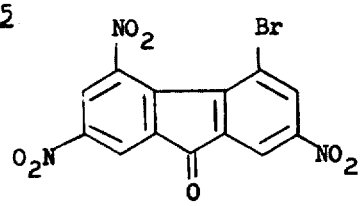

Compound 16

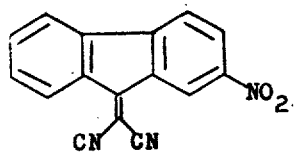

Compound 17

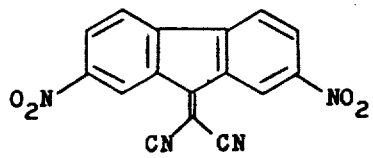

Compound 18

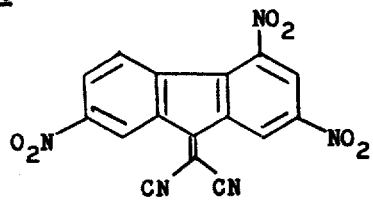

Compound 19

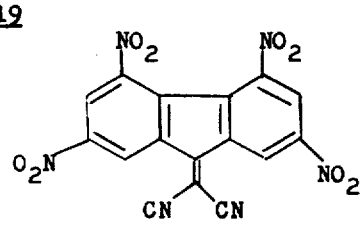

As the emulsion of the type which is reversed by the use of a nitro-substituted fluorene derivative, a previously fogged silver halide emulsion can be favorably used which does not have free electron trapping nuclei in the interior of the silver halide. An emulsion of this type is a silver halide emulsion consisting of normal crystals, preferably pure silver bromide, which has no twin surface and hardly has any crystal defects. This emulsion can further be improved by the addition of bromide ions or iodide ions, in an amount of from 1 to 20, preferably 3 to 10, mol percent of bromide or 0.2 to 3, preferably 0.5 to 2, mol percent of iodide per mole of silver, with respect to the maximum density (Dmax), clearness and sensitization. This emulsion does not provide directly a positive image by itself but a high reversal sensitization is provided by the incorporation of a nitro-substituted fluorene derivatives.

Moreover, the nitro-substituted fluorene derivative used in the invention can also be used for the sensitization of a previously fogged silver halide photographic emulsion having free electron trapping nuclei in the interior of silver halide. This emulsion is an emulsion capable of providing directly a positive image by itself. An emulsion of this type can be sensitized with a halogen acceptor or sensitizing dye by the joint use of a nitro-substituted fluorene derivative used in the invention. For this emulsion, a silver chloride or silver bromide and optionally with silver iodide or their mixed silver halide photographic emulsions can be used. The halogen composition must be so adjusted that a chemical sensitizer of Group VIII metal salt used for providing the free electron trapping nuclei can be readily incorporated into the interior of the silver halide. This emulsion can further be improved by the addition of bromide ions or iodide ions in the amounts described above with respect to the maximum density (Dmax), sensitization and clearness. Examples of the use of an original emulsion having electron trapping nuclei are described in Japanese Patent Publication Nos. 4125/1968 and 29405/1968; U.S. Pat. Nos. 2,401,051; 2,717,833; 2,976,149 and 3,023,102; British Pat. Nos. 707,704; 1,097,999 and 690,997; French Pat. Nos. 1,520,822; 1,520,824; 1,520,817 and 1,523,626; Belgian Pat. Nos. 713,272; 721,567 and 681,768; and British Patent Application No. 1650 7166. Examples of the use of an original emulsion having no electron trapping nuclei are described in British Pat. Nos. 1,186,717; 1,186,714 and 1,186,716; U.S. Pat. Nos. 3,501,306; 3,501,307; 3,501,310 and 3,531,288; French Pat. Nos. 1,520,821; 1,520,817; 1,522,354 and 1,520,824; and Belgian Pat. Nos. 695,354; 695,355; 695,362 and 695,367.

The silver halide photographic emulsion which can be used in this invention is previously fogged optically or chemically as disclosed in U.S. Pat. Nos. 2,497,875 and 3,537,858. The chemical fogging nuclei can be provided by the addition of an organic reducing compound, for example, a hydrazine derivative, formaldehyde, thiourea dioxide, a polyamine compound, an aminoborane or methyldichlorosilane.

The joint use of the reducing agent with a metal more noble than silver or with a halide ion has been proposed as described in, for example, U.S. Pat. Nos. 2,497,875; 2,588,982; 3,023,102 and 3,367,778; British Pat. Nos. 707,704; 723,017; 821,251 and 1,097,999; French Pat. Nos. 1,513,840; 1,518,095; 1,498,213; 1,518,094; 1,520,822 and 1,520,824; Belgian Pat. Nos. 708,563 and 720,660; and Japanese Patent Publication No. 13488/1968. In the emulsion of this invention, gelatin is mainly used as a protective colloid and, in particular, an inert gelatin is preferably used. In place of the gelatin, photographically inert acylated gelatin derivatives such as phthalated gelatin, and water-soluble synthetic polymers such as polyvinyl acrylate, polyvinyl alcohol, polyvinylpyrrolidone and polyvinyl alginate can be used.

The silver halide emulsion according to the invention can also contain mercapto compounds, thione compounds and tetrazaindene compounds as a stabilizer for the fog nuclei as disclosed in U.S. Pat. Nos. 2,444,605; 2,444,606, 2,444,607 and 2,444,608; stilbene compounds and triazine compounds as a modifier of the minimum density; chrome alum, 2,4-dichloro-s-triazine compounds, aziridine compounds, epoxy compounds and mucohalogenic acid compounds (halogenoformyl and maleic acid compounds) as a brightening agent as disclosed in U.S. Pat. No. 3,406,070 and German Pat. Nos. 972,067 and 1,150,274, an ultraviolet ray absorbing agent and a hardener as disclosed in U.S. Pat. Nos. 3,288,775; 3,017,280 and 2,983,611 and British Pat. No. 1,167,207; sodium polyoxyalkylenesulfonates, saponins and anionic surface active agents having a betaine structure as a coating aid as disclosed in U.S. Pat. Nos. 2,600,831; 3,068,101 and 3,415,649; vinyl compounds such as polyalkyl acrylates and copolymers of an alkyl acrylate and acrylic acid and polyalkylene oxide compounds as a preservatives and plasticizer; and color couplers as disclosed in U.S. Pat. Nos. 2,376,679; 2,698,794; 3,046,129 and 3,227,554.

For these photographic emulsions, a spectrally sensitizing dye is used jointly with the nitro-substituted fluorene derivative. Suitable spectral sensitizers are dyes such as the cyanines, merocyanines, composite trinuclear cyanines, composite trinuclear merocyanines, styryls and hemicyanines.

In particular, a high sensitivity emulsion is obtained by the joint use of a dimethine dye such as is disclosed in U.S. patent applications Ser. Nos. 318,047, filed on Dec. 26, 1972; 351,386, filed on Apr. 16, 1973 and 379,887, filed on July 16, 1973. The grain size of silver halide in the photographic emulsion used in the invention is not limited, however the average grain size is preferably 0.05 – 1.0 microns. The form of the silver halide used can be either regular or irregular, but, in particular, the regular form is preferable. The effect of the invention is favorably provided by a mono-dispersed emulsion, although other emulsions than the mono-dispersed emulsion can, of course, be used.

The quantity of the nitro compound which can be used in the invention will vary depending upon the quantity of silver halide in the emulsion, the surface area and the end-use desired, but, preferably, from $1 \times 10^{-5}$ to $5 \times 10^{-2}$ mol per 1 mol of the silver salt is generally employed. The nitro compound is ordinarily added in the form of a solution in a suitable solvent such as water or an organic solvent miscible with water, e.g., alcohols such as methanol and ethanol, ethers such as ethylene glycol monomethyl ether, ketones such as methyl ethyl ketone and acetone, nitrogen containing compounds such as pyridine or a mixture of these solvents.

The addition of the nitro-substituted fluorene derivative to an emulsion is preferably carried out immediately before coating, but can be carried out during the chemical ageing of the emulsion or during the precipitating of the silver halide.

The silver halide photographic emulsion for direct positive use according to the instant invention is suitable not only for high contrast light-sensitive materials as direct positives, such as light-sensitive materials for lith-film copying originals, but also relatively low contrast light-sensitive materials for direct positive use, such as light-sensitive materials of microphotographs or X-ray photographs. Moreover, it can be adapted to color light-sensitive materials, in particular, blue-sensitive layers, and, in addition to the use of light radiation, irradiation with electron rays, X-rays, and $\gamma$-rays can also be used.

A first feature of the invention is to obtain a high reversal sensitivity within the blue range (e.g., about 400 to 500 nm) where a nitro-substituted fluorene derivative is used for sensitization. In particular, a compound substituted with three nitro groups such as compound 3 and compound 18 described hereinbefore gives a high sensitivity.

A second feature of the invention is that the nitro-substituted fluorene derivative used in the invention does not reduce the maximum density (Dmax) of an original emulsion.

A third feature of the invention is that a direct positive emulsion sensitized with the nitro-substituted fluorene derivative of the invention retains a predetermined maximum density and, simultaneously, retains a low minimum density.

A fourth feature of the invention is that the nitro-substituted fluorene derivative used in the invention leaves substantially no residual color on a light-sensitive material after processing.

The nitro-substituted fluorene derivative of the invention can be used not only for the sensitization of previously fogged emulsions for direct positives, but also for various photographic objects in which known desensitizers for silver halide photography are used. For example, (1) using an aqueous solution of the desensitizer as a pretreatment bath, a high sensitivity photographic material photgraphed is treated in this bath and developed while observing the progress of the development under a relatively bright illumination; (2) development is carried out in a mixed solution of the desensitizer and a developer, whereby the sensitivity of a photographic light-sensitive material is reduced and the development can be accomplished under a relatively bright illumination; and (3) as described in Japanese Patent Disclosure No. 3285/1972, the desensitizer can be used for an emulsion consisting of an internally latent image type silver halide doped with a multivalent metal ion. Examples of suitable metal ions include $Pb^{2+}$, $Sb^{3+}$, $As^{3+}$, $Au^{3+}$, $Bi^{3+}$, $Rh^{3+}$, $Pt^{4+}$, $Os^{4+}$, $Ir^{4+}$ and $Ir^{3+}$ as disclosed in Japanese Patent Application Laid Open to Inspection No. 32813/72.

The following examples are given to illustrate the invention in greater detail without limiting the invention. Unless otherwise indicated, all parts, percents, ratios, etc., are by weight.

EXAMPLE 1

The method of preparing the emulsion used in this example was as follows.

To a first solution prepared by mixing 8 g of inert gelatin, 5 ml of a 1 N solution of potassium bromide and 500 ml of water and heating to dissolve at 60°C were added a second solution prepared by adding 100 g of silver nitrate ot 500 ml of water and heating to dissolve at 60°C and a third solution prepared by adding 70 g of potassium bromide to 150 ml of water and heating to dissolve at 60°C with stirring for a period of 50 minutes, and then the mixture was subjected to physical ageing for 5 minutes. Then 15 ml of a 0.2 N solution of potassium iodide was added and the pAg was adjusted to 6.0 using a solution of silver nitrate. Hydrazine (0.005 millimole per 1 mol of silver halide) and a chloroaurate (0.005 millimole per 1 mol of silver halide) were added to the mixture and the pH of the mixture was adjusted to 10 using a sodium hydroxide solution. Following this the mixture was aged. The mixture was then neutralized with citric acid, washed with water, melted and then mixed with a fourth solution prepared by dissolving 75 g of inert gelatin in 300 ml of water to obtain a silver halide emulsion (original emulsion). The resulting emulsion had a silver halide average grain size of about 0.2 micron in diameter and contained silver halide grains of normal tetragonal system having a (100) plane.

The compound of the invention was added to the above described original emulsion with 20 cc of an aqueous solution containing 1% by weight of saponin per 1 kg of the emulsion, and coated onto a film of cellulose triacetate to provide a thickness of 5 microns on dry basis. The coated specimen was exposed to a tungsten light at a color temperature of 2854°K through an optical wedge, developed at 20°C for 2 minutes with the following developer, fixed to give a strip and the strip was then subjected to measurement of the density using a P-type Densitometer manufactured by the Fuji Photo Film Co., Ltd. thus obtaining a characteristic curve. The results of the sensitometry are shown in Table 1.

| Composition of Developer | |
|---|---|
| Metol | 3.1 g |
| Anhydrous Sodium Sulfite | 45 g |
| Hydroquinone | 12 g |
| Sodium Carbonate Monohydrate | 79 g |
| Potassium Bromide | 2 g |
| Water to | 1,000 ml |

This composition was used after dilution with water in a proportion by volume of 1:1.

In Table 1, the sensitivity is represented by the reciprocal of the exposure quantity E required to give a density of (Dmax + Dmin)/2 while setting the sensitivity of each comparative dye at 100 as a standard. Dmax shows the maximum optical density and Dmin shows the minimum optical density.

Table 1

| Test No. | Compound (molar concentration) ml/100 g emulsion | Sensitivity | Dmax | Dmin |
|---|---|---|---|---|
| 1 | — | — | 2.2 | — |
| 2 | 1 ($8 \times 10^{-2}$) 16 | 100 | 2.1 | 0.05 |
| 3 | 2 ( " ) " | 112 | 2.2 | 0.05 |
| 4 | 3 ( " ) " | 190 | 2.2 | 0.04 |
| 5 | 4 ( " ) " | 125 | 2.2 | 0.05 |
| 6 | 9 ( " ) " | 108 | 2.1 | 0.05 |
| 7 | 11 ( " ) " | 105 | 2.1 | 0.05 |
| 8 | 14 ( " ) 24 | 178 | 2.2 | 0.04 |
| 9 | 15 ( " ) " | 155 | 2.2 | 0.04 |
| 10 | 18 ( " ) " | 125 | 2.2 | 0.04 |
| 11 | A ( " ) 16 | 100 | 1.3 | 0.05 |
| 12 | A ( " ) 24 | 87 | 1.3 | 0.04 |
| 13 | B ( " ) 16 | 89 | 2.2 | 0.23 |
| 14 | B ( " ) 24 | 78 | 2.1 | 0.20 |
| 15 | C ( " ) 16 | 46 | 2.2 | 0.05 |
| 16 | C ( " ) 24 | 40 | 2.1 | 0.04 |

Compound A: Pinakryptol Yellow
Compound B: 3-Ethyl-5-m-nitrobenzilidene Rhodanine
Compound C: 5-m-Nitrobenzilidene Rhodanine Compounds A, B and C were used for comparison.

As is evident from the results contained in Table 1, the compounds of the invention provide better reversal characteristics than the comparative compounds.

EXAMPLE 2

The method of preparing the emulsion used in this example was as follows.

To a first solution prepared by adding 10 g of inert gelatin to 5 ml of a 1 N solution of sodium chloride and 500 ml of water and warming to dissolve at 60°C were added with agitation a second solution prepared by adding 100 g of silver nitrate to 500 ml of water and warming to dissolve at 60°C and a third solution prepared by adding 35 g of sodium chloride to 300 ml of water and warming to dissolve at 60°C, for a period of 20 minutes.

After the addition, the mixture was aged for 5 minutes, mixed with agitation with a fourth solution prepared by adding 14 g of potassium bromide to 200 ml of water and warming to dissolve at 60°C, for a period of 20 minutes, then aged for 10 minutes, cooled and washed with water. After melting, the pH was adjusted to 10. Hydrazine (0.005 millimole per 1 mol of silver halide) and a chloroaurate (0.005 millimole per 1 mol of silver halide) were then added followed by ageing for 10 minutes and the pH was adjusted to 6.5 using citric acid. A fifth solution was prepared by dissolving 75 g of inert gelatin in 300 ml of water and added to obtain a silver halide emulsion. The thus resulting silver halide emulsion (original emulsion) contained silver halide of an average grain size of about 0.15 micron in diameter.

To the above described original emulsion were added a 2-phenylindole nucleus-containing dimethine dye as shown below, a nitro-substituted fluorene derivative as set forth below, 80 ml/kg-emulsion of a 10% aqueous solution of potassium bromide and 20 cc of an aqueous solution containing 1% by weight of saponin per 1 kg of the emulsion and 50 cc of an aqueous solution containing 2% of mucochloric acid per kg emulsion, and then the resulting emulsion was coated onto a film of cellulose triacetate to provide a thickness of 2 microns on dry basis. The coated specimen was exposed to a tungsten light at a color temperature of 2854°K through an optical wedge, developed at 20°C for 3 minutes with a developer as described in Example 1 consisting mainly of a polyhydroxybenzene, fixed to give a strip and the strip was then subjected to measurement of the density using a P-type Densitometer manufactured by the Fuji Photo Film Co., Ltd. thus obtaining a characteristic curve. The results of the sensitometry are shown in Table 2.

Table 2

| Test No. | Compound (molar concentration) ml/100 g emulsion | Sensitivity | Dmax | Dmin |
|---|---|---|---|---|
| 1 | 2-Phenylindole nucleus-containing Dimethine Dye* only ($8 \times 10^{-2}$) 8 | 100 | 3.4 | 0.16 |
| 2 | " + 3($8 \times 10^{-2}$) 16 | 345 | 2.8 | 0.05 |
| 3 | " +15($8 \times 10^{-2}$) 16 | 288 | 2.8 | 0.05 |
| 4 | " +19($8 \times 10^{-2}$) 16 | 232 | 2.9 | 0.06 |

*A dye having the following chemical structure was used:

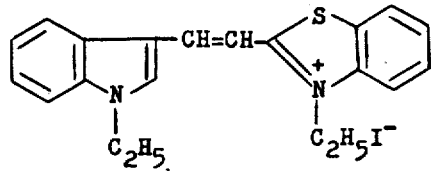

As is evident from the results contained in Table 2, the reversal sensitivity was greatly increased and the minimum density was reduced by the joint use of the nitro-substituted fluorene derivative of the invention with a sensitizer.

While the invention has been described in detail and with reference to specific embodiments thereof, it will be apparent to one skilled in the art that various changes and modifications can be made therein without departing from the spirit and scope thereof.

What is claimed is:

1. A fogged silver halide photographic emulsion for direct positives, containing $1 \times 10^{-5}$ to $5 \times 10^{-2}$ moles per mole of silver halide of a fluorene compound having at least one nitro group as a substituent, which said nitro-substituted fluorene compound has the following general formula (1),

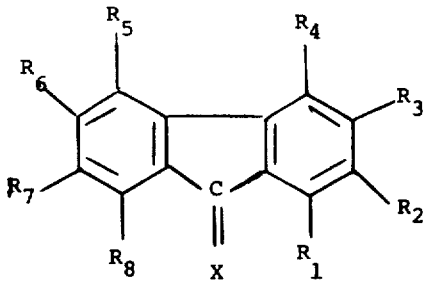

in which X is an oxygen atom or

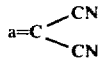

group, and $R_1$ to $R_8$ each are a hydrogen atom, an alkyl group, a hydroxyl group, a halogen atom or a nitro group, with at least one of $R_1$ to $R_8$ being a nitro group.

2. The silver halide photographic emulsion of claim 1, in which X is an oxygen atom.

3. The silver halide photographic emulsion of claim 1, in which X is

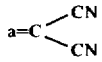

group.

4. The silver halide photgraphic emulsion of claim 1, in which at least $R_2$ and $R_7$ are nitro groups.

5. The silver halide photographic emulsion of claim 1, in which $R_2$, $R_4$ and $R_7$ are nitro groups and $R_1$, $R_3$, $R_5$, $R_6$ and $R_8$ are hydrogen atoms.

6. The silver halide photographic emulsion of claim 1, in which said emulsion contains a spectral sensitizing dye.

7. Tne silver halide photographic emulsion of claim 6, in which said sensitizer is a dimethine dye.

8. The silver halide photographic emulsion of claim 1, wherein said nitro-substituted fluorene compound is

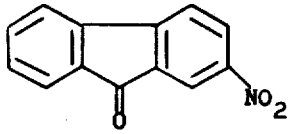

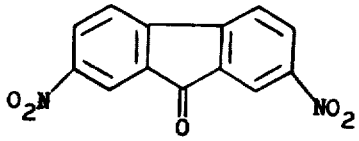

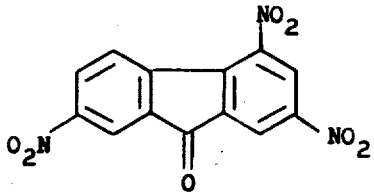

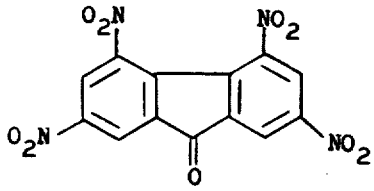

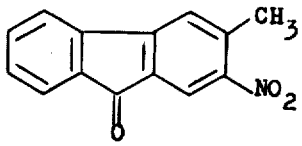

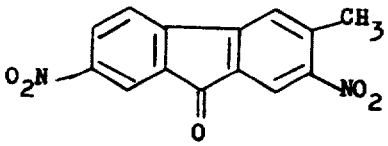

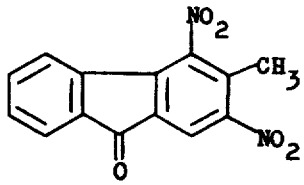

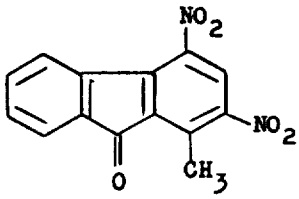

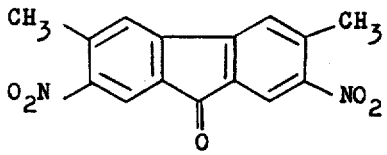

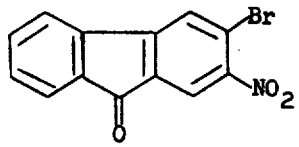

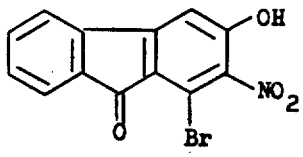

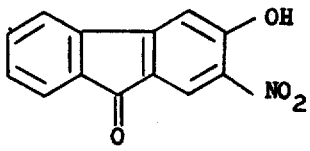

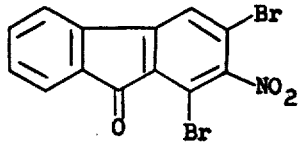

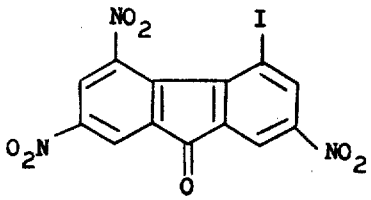

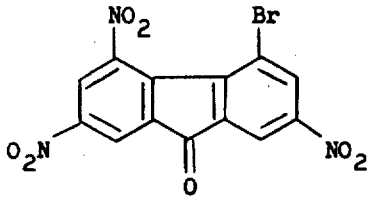

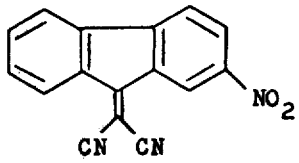

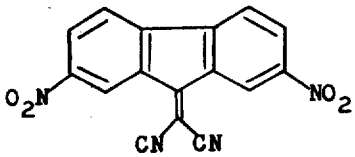

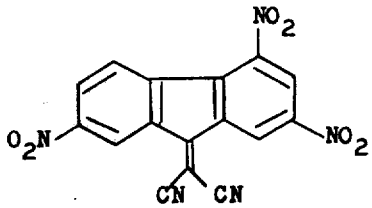

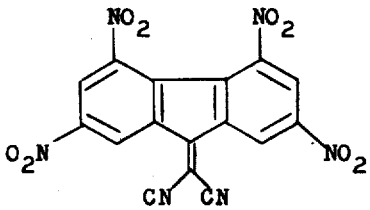

9. A light sensitive element comprising a support and having thereon the silver halide photographic emulsion of claim 1.

10. The light sensitive element of claim 9, in which X is an oxygen atom.

11. The light sensitive element of claim 9, in which X is

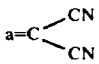

group.

12. The light sensitive element of claim 9, in which at least $R_2$ and $R_7$ are nitro groups.

13. The light sensitive element of claim 9, in which $R_2$, $R_4$ and $R_7$ are nitro groups and $R_1$, $R_3$, $R_5$, $R_6$ and $R_8$ are hydrogen atoms.

14. The light sensitive element of claim 9 in which said emulsion contains a spectral sensitizing dye.

15. The light sensitive element of claim 14, in which said sensitizer is a dimethine dye.

16. The light sensitive element of claim 9, in which said nitro-substituted fluorene compound is
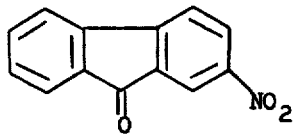
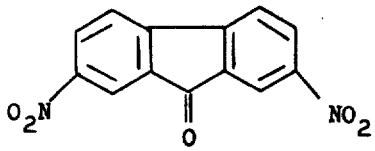
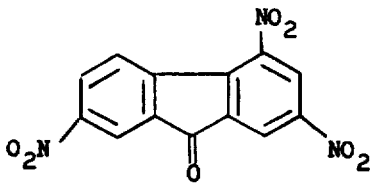
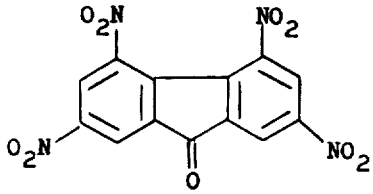
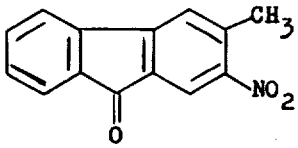
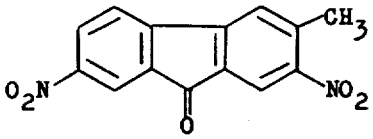
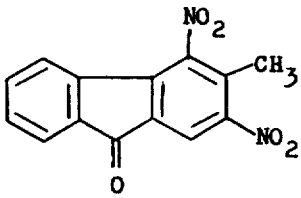
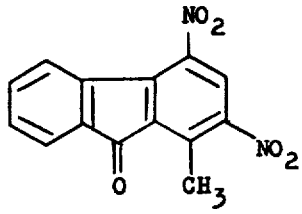
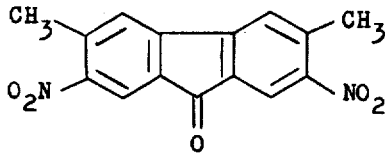
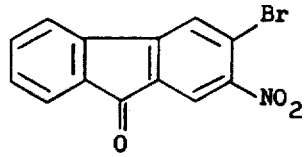
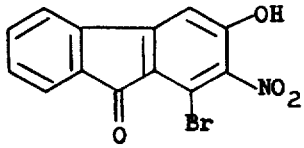
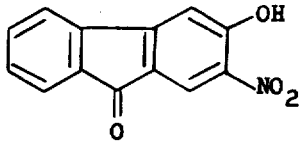
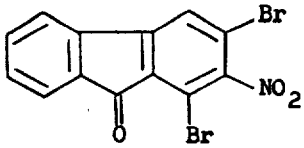
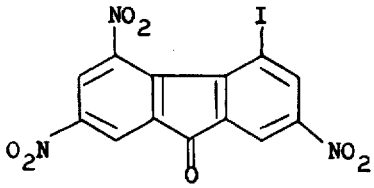
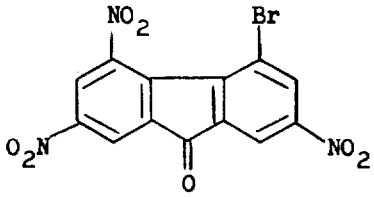

17

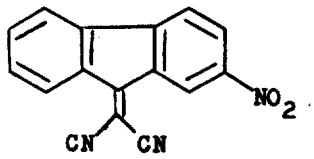

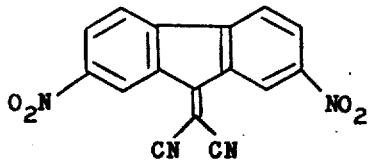

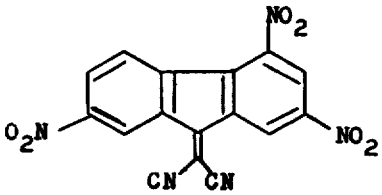

18

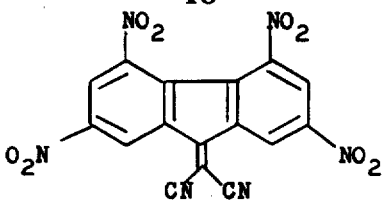

17. The silver halide photographic emulsion of claim 1, wherein said spectral sensitizing dye is selected from the group consisting of cyanine, a merocyanine, a styryl and a hemicyanine dye.

18. The silver halide photographic emulsion of claim 17, wherein said cyanine dye is a composite trinuclear cyanine dye.

19. The silver halide emulsion of claim 17, wherein said merocyanine dye is a composite trinuclear merocyanine dye.

20. The light-sensitive element of claim 9, wherein said spectral sensitizing dye is selected from the group consisting of cyanine, a merocyanine, a styryl and a hemicyanine dye.

21. The light sensitive element of claim 20, wherein said merocyanine dye is a composite trinuclear cyanine dye.

22. The light-sensitive element of claim 20, wherein said merocyanine dye is a composite trinuclear merocyanine dye.

* * * * *